United States Patent [19]

Itoh et al.

[11] Patent Number: 4,865,886

[45] Date of Patent: Sep. 12, 1989

[54] PROCESS FOR PREPARATION OF WATER ABSORPTIVE COMPOSITE MATERIAL

[75] Inventors: Kiichi Itoh; Takeshi Shibano, both of Yokkaichi, Japan

[73] Assignees: Mitsubishi Petrochemical Company Limited, Tokyo; Uni-Charm Corporation, Kawanoe, both of Japan

[21] Appl. No.: 88,277

[22] Filed: Aug. 24, 1987

[30] Foreign Application Priority Data

Aug. 29, 1986 [JP] Japan ..... 61-201354

[51] Int. Cl.[4] ..... B05D 3/04; B05D 3/10

[52] U.S. Cl. ..... 427/342; 427/389.9; 427/391; 427/392; 8/116.1; 8/115.6; 8/115.7; 502/402; 525/301; 525/445; 527/314

[58] Field of Search ..... 502/402; 527/314; 8/116.1, 115.6, 115.7; 525/301, 445; 427/389.9, 391, 412, 392, 342

[56] References Cited

U.S. PATENT DOCUMENTS

| | | | |
|---|---|---|---|
| 3,056,695 | 10/1962 | von Brachel | 427/389.9 |
| 3,995,998 | 12/1976 | Rowland et al. | 8/115.7 |
| 4,008,353 | 2/1977 | Gross et al. | 427/391 |
| 4,072,784 | 2/1978 | Cirino et al. | 427/393.3 |
| 4,304,564 | 12/1981 | Frick, Jr. et al. | 427/393.2 |
| 4,541,871 | 9/1985 | Obayashi et al. | 527/314 |
| 4,647,617 | 3/1987 | Saotome | 527/314 |
| 4,721,647 | 1/1988 | Nakanishi et al. | 428/283 |

FOREIGN PATENT DOCUMENTS

| | | | |
|---|---|---|---|
| 116267 | 5/1985 | Japan . | |
| 2176815 | 1/1987 | United Kingdom | 502/402 |

*Primary Examiner*—William R. Dixon, Jr.
*Assistant Examiner*—Jerry D. Johnson
*Attorney, Agent, or Firm*—Oblon, Spivak, McClelland, Maier & Neustadt

[57] ABSTRACT

There is provided a process for preparing a water absorptive composite material, which comprises the combination of the following steps of:

(A) applying an aqueous solution of a polymerizable monomer comprising as a main component acrylic acid, of which 20% or more of the carboxyl groups have been neutralized to its alkali metal salt or ammonium salt, to a prefabricated fibrous substrate;

(B) polymerizing the polymerizable monomers applied to said fibrous substrate to form a composite of a polymer derived from said polymerizable monomer and said fibrous substrate; and (C) adding to said composite a crosslinking agent having two or more functional groups reactive with the carboxyl groups and/or carboxylate groups contained in the polymer to react therewith.

13 Claims, No Drawings

PROCESS FOR PREPARATION OF WATER ABSORPTIVE COMPOSITE MATERIAL

BACKGROUND OF THE INVENTION

1. Field of the Art

This invention relates to a process for preparing a water absorptive composite material comprising a water absorptive polymer and a prefabricated fibrous substrate. More particularly, this invention relates to a process for preparing a water absorptive composite material in which a highly water absorptive polymer is held on a prefabricated substrate, comprising applying an aqueous solution of an acrylic acid type monomer to a prefabricated fibrous substrate, polymerizing the acrylic acid type monomer to obtain a precursor of the composite, which is further subjected to crosslinking.

The water absorptive composite material obtained by the process according to this invention can be advantageously used in the production of a variety of water absorptive materials, because it is excellent in water absorption properties and the highly water absorptive polymer is held with good stability on the fibrous substrate.

2. Prior Art

Materials such as paper, pulp, nonwoven fabric, spongy urethane resins and the like have hitherto been used as water retentive materials for a variety of sanitary goods such as a sanitary napkin, paper diaper and the like and a variety of agricultural materials. However, these materials have a water absorption capacity of no more than 10–50 times their own weight, which will cause problems that an extensively increased bulk of the material is required for absorbing or retaining a large amount of water and that water is easily released from the material in which water has been absorbed on pressing it.

There have recently been proposed a variety of highly water absorptive polymer materials in order to settle the aforementioned problems of the water absorptive materials of this kind. For instance, there have been proposed a graft polymer of starch (Japanese Patent Publication No. 46199/78, etc.), a denaturated cellulose (Unexamined Published Japanese Patent Application No. 80376/75, etc.), a crosslinked water soluble polymer (Japanese Patent Publication No. 23462/68, etc.), a self crosslinking polymer of an alkali metal salt of acrylic acid (Japanese Patent Publication No. 30710/79, etc.), and the like.

However, these highly water absorptive polymer materials, while having a relatively high level of water absorption properties, are obtained as powder in most cases. Therefore, in order to use them for sanitary goods such as a sanitary napkin, paper diaper or the like, it is necessary to disperse them homogeneously on such substrates as tissue paper, nonwoven fabric, cotton or the like. However, the polymer powder having been dispersed in such a manner is difficult to be firmly held on the substrate and often agglomerate partially. Also, swollen gel after water absorption will easily move from the substrate without being held firmly on it. Therefore, if it is used for a paper diaper, for example, it will give the feeling of stiffness upon urination accompanied with the extremely uncomfortable feeling on wearing. Furthermore, in a process for obtaining an absorber by dispersing such a powdery polymer as described above on a substrate, the absorber will be very expensive because of complicated procedures for powder handling and of problems on processes for efficiently conducting uniform dispersion.

As a method for dissolving these problems, there is disclosed a process for producing a water absorptive composite in which an aqueous solution of an acrylic acid type monomer is applied in a previously determined pattern to a prefabricated fibrous substrate to obtain a composite, which is then irradiated with electromagnetic radiation or corpuscular ionizing radiation to convert the acrylic acid type monomer into a highly water absorptive polymer (Unexamined Japanese PCT Patent Publication No. 500546/82). According to this process, uniform dispersion and stable holding of the aforementioned powder on a substrate are considerably improved. However, since electromagnetic radiation or corpuscular ionizing radiation is employed for converting the monomer into the high water absorptive polymer in this process, the highly water absorptive polymer inherent to the specific monomer tends to be crosslinked excessively. As the result, the composite obtained will exhibit extremely poor properties as an absorber. Especially its water absorption capacity will be of a level of only half or less of that of the composite obtained by using the aforementioned highly water absorptive powdery polymer.

More recently, Unexamined Published Japanese Patent Application No. 149609/85 discloses a process for preparing a water absorptive composite material comprising previously impregnating a water absorptive organic material with an aqueous solution of an acrylic acid type monomer and adding thereto in a mist form a water soluble radical polymerization initiator, or, a water soluble radical polymerization initiator and a water soluble reducing agent to conduct polymerization. In this process, however, the water soluble polymerization initiator is added after the water absorptive organic material has been impregnated with the acrylic acid type monomer. Thus, although the polymerization initiator is added in a mist form, it is very difficult to completely polymerize the monomer because of occurrence of "uneven polymerization" and as the result the amount of the residual monomers is in a high level, which will cause problems on safety and lead to lowering of the properties of the resulting product, especially in respect of its water absorption capacity.

POSSIBLE COUNTERMEASURE

Under these backgrounds, the present inventors have already proposed in Japanese Patent Application No. 193403/85 a method that an aqueous solution of an acrylic acid type monomer having a monomer concentration of 25% by weight or more and either a water soluble radical polymerization initiator or a water soluble radical polymerization initiator and a water soluble reducing agent are previously mixed homogeneously and the mixture is applied in a mist form to a prefabricated fibrous substrate so that the resulting highly water absorptive polymer in the fibrous substrate will have a diameter in the range of 30–500 $\mu$m, followed by polymerization; in Japanese Patent Application No. 202908/85 a method that an aqueous solution of an acrylic acid type monomer containing a small amount of a crosslinking agent and either a water soluble radical polymerization initiator or a water soluble radical polymerization initiator and a water soluble reducing agent are previously mixed homogeneously and the mixture is applied in a mist form to a prefabricated fibrous substrate so that the resulting highly water absorptive polymer in the fibrous substrate will have a diameter in the range of 30–500 μm, followed by polymerization; in Japanese Patent Application No. 238421/85 a method that an aqueous solution of an acrylic acid type monomer containing a small amount of a crosslinking agent and an oxidizing radical polymerization initiator are previously mixed and the mixture is applied to a fibrous substrate, and then an amine or a reducing agent is added to conduct polymerization; and in Japanese Patent Application No. 238420/85 a method that an aqueous solution of an acrylic acid type monomer containing a small amount of a crosslinking agent and an amine or a reducing agent are mixed, followed by application to a fibrous substrate and then addition of an oxidizing radical polymerization initiator to conduct polymerization; and the like.

In accordance with these methods a considerable improvement is attained in the above mentioned defect involved in powdery polymers, namely uneven dispersion and unstable fixing thereof on a substrate. However, the water absorption velocity of a water absorptive composite obtained by these methods is still low, thus causing problems on use for sanitary goods such as a sanitary napkin, paper diaper and the like.

SUMMARY OF THE INVENTION

1. Object of the Invention

This invention is an improvement of water absorptive composites described in Unexamined Japanese PCT Patent Publication No. 500546/82 and Unexamined Published Japanese Patent Application No. 149609/85 and proposed by the present inventors in Japanese Patent Application Nos. 193403/85, 202908/85, 238421/85 and 238420/85, providing a process for preparing very easily under a moderate condition a water absorptive composite material which is excellent in water absorption capacity, especially in its remarkably high water absorption velocity.

2. The Invention

The present inventors have conducted an intensive research in order to solve the aforementioned problems. As the result, they have found that a water absorptive composite material, which is excellent in water absorption capacity, especially in its remarkably high water absorption velocity and in which the highly water absorptive polymer is held with good stability on the fibrous substrate, can be obtained very easily at low cost by applying an aqueous solution of an acrylic acid type monomer to a prefabricated substrate to polymerize the acrylic acid type monomer and then carrying out crosslinking of the polymer obtained with its carboxyl groups and/or carboxylate groups as crosslinked points, and finally reached this invention.

Thus, the process for preparing the water absorptive composite material according to this invention is characterized by the combination of the following steps:

(A) applying an aqueous solution of a polymerizable monomer comprising as a main component acrylic acid, of which 20% or more of the carboxyl groups have been neutralized to its alkali metal salt or ammonium salt, to a prefabricated fibrous substrate, (B) polymerizing the polymerizable monomers applied to said fibrous substrate to form a composite of a polymer derived from said polymerizable monomer and said fibrous substrate, and (C) adding to said composite a crosslinking agent having two or more functional groups reactive with the carboxyl groups and/or carboxylate groups contained in the polymer to react therewith.

The process for preparing the water absorptive composite material of this invention is very advantageous in that most of the acrylic acid monomer applied to the prefabricated substrate are polymerized to form a highly water absorptive polymer whereby the composite material obtained has an increased water absorption capacity, and that since said highly water absorptive polymer is subjected to crosslinking treatment, the composite material obtained has an extremely high water absorption velocity, and, the highly water absorptive polymer is held firmly on the fibrous substrate. Thus, a water absorptive composite material far excellent in properties as compared with those of the above mentioned prior art can be obtained easily and inexpensively.

In the crosslinking conducted at the step (C), the carboxyl groups and/or carboxylate groups contained in the acrylic acid type polymer in the composite obtained at the step (B) are assumed to function as crosslinking sites. It should thus be unexpected that the water absorption velocity of the composite is improved through modification by crosslinking at the sacrifice of the carboxyl and/or carboxylate groups since the water absorption capacity of the composite material in accordance with the present invention is understood to owe at least partly to the existence of such hydrophilic groups.

EMBODIMENT OF THE INVENTION

Steps (A) and (B)

Monomer

The monomer used in this invention contains as a main component acrylic acid, of which 20% or more, preferably 50% or more of the carboxyl groups are neutralized into its alkali metal salt or an ammonium salt. If the partial neutralization degree is less than 20%, the water absorption capacity of the resulting polymer will be remarkably decreased.

In this invention, a polymer having a higher water absorption capacity may be obtained by adding in addition to the aforementioned acrylic acid and its salts one or two of the monomers copolymerizable therewith selected from the group consisting of 2-acrylamide-2-methylpropanesulfonic acid, 2-acryloylethanesulfonic acid, 2-acryloylpropanesulfonic acid, methacrylic acid and alkali metal salts or ammonium salts thereof, (meth)acrylamide, N,N-dimethyl(meth)acrylamide, 2-hydroxyethyl (meth)acrylamide, 2-vinylpyridine, 2-hydroxyethyl (meth)acrylate, 2-hydroxypropyl (meth)acrylate, polyethylene glycol mono(meth)acrylate, N,N'-methylenebis(meth)acrylamide and polyethylene glycol di(meth)acrylate. The term "(meth)acryl" herein used means acryl and methacryl. It is also possible to incorporate other monomers copolymerizable with acrylic acid and acrylic acid salts including water soluble monomers such as itaconic acid, maleic acid, fumaric acid, vinylsulfonic acid and alkali metal salts or ammonium salts thereof and in addition less water soluble monomers such as alkyl esters of acrylic acid, for example methyl acrylate, ethyl acrylate and the like, providing that "an aqueous solution of a polymerizable monomer" of this invention is formed.

The "polymerizable monomer" of this invention comprises as a main component acrylic acid, of which 20% or more takes the salt form. Thus, the addition amount of the aforementioned copolymerizable monomer is usually less than 50 mol %, preferably 20 mol % or less.

For neutralization of the aforementioned acid monomers including acrylic acid may be used a hydroxide or bicarbonate of an alkali metal or ammonium hydroxide, preferably an alkali metal hydroxide, specifically sodium hydroxide, potassium hydroxide and lithium hydroxide. Sodium hydroxide or potassium hydroxide is preferred from the standpoint of commercial availability, price, safety and the like.

In this invention, the polymerizable monomer comprising as a main component the aforementioned acrylic acid, of which 20% or more is present in its salt form, is applied in the form of an aqueous solution to a prefabricated fibrous substrate. Any concentration of the aqueous solution may be employed as far as it is suitable for the object. Specifically, it is preferably in the range of 30% by weight or more.

This aqueous solution may contain a variety of substances providing that they are not apart from the object of this invention. As an example of such substances, there is mentioned a water soluble radical polymerization initiator (described in detail hereafter). The "aqueous solution" may be the one in which a small amount of a water soluble organic solvent is also present in solution, if desired.

Prefabricated fibrous substrate

A prefabricated substrate to which the aforementioned aqueous solution of the polymer is applied is specifically a substrate formed by loose fabrication of fiber such as a pad, a carded or air-laid web, tissue paper, a woven fabric like cotton gauze, knitted fabric or nonwoven fabric. The term "prefabricated" fibrous substrate herein used means the substrate which requires no web forming operation, though some operations such as cutting, bonding, shaping and the like may be required for incorporating the fibrous substrate into an article.

In general, absorptive fibers including cellulose fibers such as wood pulp, rayon, cotton and the like and/or polyester fibers are preferably used as a main component for the fibrous substrate. Other kinds of fibers such as those of polyethylene, polypropylene, polystyrene, polyamide, polyvinyl alcohol, polyvinyl chloride, polyvinylidene chloride, polyacrylonitrile, polyurea, polyurethane, polyfluoroethylene, polyvinylidene cyanide and the like may be also incorporated into the prefabricated fibrous substrate.

Application of an aqueous solution of the monomer and polymerization of the monomer In this invention, the aforementioned monomer solution is applied to the aforementioned prefabricated fibrous substrate, and the monomer is polymerized on the fibrous substrate.

In order to apply the aqueous monomer solution to the prefabricated fibrous substrate, there may be used any means or manner suitable for the object as far as the monomer is uniformly dispersed and held on the fibrous substrate and can be subjected to polymerization. One of the typical means therefor is to impregnate the aqueous monomer solution into the fibrous substrate or to spray the aqueous monomer solution onto the fibrous substrate.

The application of the monomer solution to the fibrous substrate is preferably conducted either in a manner that the solution applied will form a pattern of continued stripes along the fibers of the substrate or in a manner that the solution will make small spots uniformly dispersed on the substrate. As a specific method for practicing the former manner of application, there may be a method comprising impregnating the monomer solution into the prefabricated fibrous substrate or spraying a large quantity of the solution onto the substrate, and then removing off by suction the monomer solution between the fibers and a method comprising applying the monomer solution to the fibrous substrate by means of a roll coater. The latter manner of application is usually conducted by spraying the monomer solution onto the prefabricated fibrous substrate. It is desirable in this case of spraying to predetermine the condition so that the particle size of the solution upon spray will be 30 to 500 μm, preferably 30 to 200 μm in diameter.

For polymerizing the monomer which has been dispersed uniformly on the fibrous substrate as described above, any method can be used as far as it is suitable for the object. Typical methods include a method utilizing a water soluble radical polymerization initiator, more specifically, a method wherein a radical polymerization initiator has previously been added in the aqueous monomer solution and is decomposed on the fibrous substrate, a method wherein a radical polymerization initiator is applied uniformly in the form of a separate solution from the aqueous monomer solution to the fibrous substrate, to which the aqueous monomer solution has been applied, by spraying or the like and is decomposed on the fibrous substrate and a method wherein a radical polymerization initiator is applied uniformly in the form of a separate solution from the aqueous monomer solution to the fibrous substrate and then the aqueous monomer solution is uniformly applied thereto by spraying, coating or the like.

As another method for polymerization, there may be mentioned a method comprising initiating polymerization by irradiation with a high-energy radiation.

The water soluble radical polymerization initiator used in this invention is one well known in the art of polymer chemistry. There may be mentioned specifically inorganic or organic peroxides such as persulfates (ammonium salts, alkali metal salts, particularly potassium salts, or the like), hydrogen peroxide, ditert-butyl peroxide, acetyl peroxide and the like. In addition to these peroxides, it is also possible to use such a radical polymerization initiator as an azo compound or the like, for example 2,2'-azobis(2-amidinopropane) dihydrochloride, providing that water solubility in a certain level can be obtained.

The polymerization is initiated by the decomposition of the radical polymerization initiator. Well known as a conventional means for decomposing the initiator is heating (As is often the case, when the initiator is contacted with the monomer the reaction mixture has already been raised at the decomposition temperature and thus the polymerization is initiated only by adding the polymerization initiator to the monomer without heating. This case is involved herein in the category of the decomposition by heating). Promotion of the decomposition of the polymerization initiator by means of a chemical substance is also well known in the art. When the polymerization initiator is a peroxide, a promoter of the decomposition thereof is a reducing compound (which is water soluble in this invention) such as an acidic sulfite, ascorbic acid and an amine for a persulfate, and a polymerization initiator comprising a combination of a peroxide and a reducing compound is well known in the art of polymer chemistry as "redox initiator". Thus, the term "polymerization initiator" herein used also involves initiator combined with such decomposition promoting substances, particularly redox initiators.

As regards the high-energy radiation, there may be used in the present invention an electromagnetic radiation, corpuscular radiation and the like.

The polymerization by the above mentioned means, above all, by the action of a water soluble radical polymerization initiator of the monomer comprising as a main component acrylic acid, of which 20% or more is in the salt form, should give in principle a noncrosslinking water soluble polymer as far as a diethylenic monomer such as N,N'-methylene bis(meth)acrylamide is not used concomitantly. However, it has been practically known that crosslinking usually occurs between acrylic acids (or its salts) or the polymers thereof or/and between those and the fibrous substrate. Accordingly, the polyacrylic acid (salt) produced in this step may be considered as highly water absorptive polymer rather than water soluble polymer.

In addition, the polymerization by means of the water soluble radical polymerization initiator should be substantially aqueous solution polymerization. Accordingly, the step (B) should be conducted while avoiding the excessively dry state.

The amount of the monomer applied to the fibrous substrate during the step (A) is in a proportion of 1–10,000 parts by weight, preferably 10–1,000 parts by weight per 100 parts by weight of the fibrous substrate. The monomer thus applied should be polymerized in the step (B) to an extent of 50% or more, preferably 80% or more. Rate of polymerization ordinarily reaches up to 80–95% in the step (B).

Some of the embodiments of the steps (A) and (B) are illustrated as follows:

(1) A method that an aqueous solution of an acrylic acid type monomer having a monomer concentration of 25% by weight or more and a water soluble radical polymerization initiator are previously mixed homogeneously and the mixture is applied in a mist form to a prefabricated fibrous substrate so that the resulting highly water absorptive polymer in the fibrous substrate will have a diameter in the range of 30–500 μm, followed by polymerization by heating if the polymerization initiator used is not a redox type (see Japanese Patent Application No. 193403/85);

(2) A method that an aqueous solution of an acrylic acid type monomer containing a small amount of a crosslinking agent and a water soluble radical polymerization initiator are previously mixed homogeneously and the mixture is applied in a mist form to a prefabricated fibrous substrate so that the resulting highly water absorptive polymer in the fibrous substrate will have a diameter in the range of 30–500 μm, followed by polymerization by heating if the polymerization initiator used is not a redox type (see Japanese Patent Application No. 202908/85);

(3) A method that an aqueous solution of an acrylic acid type monomer containing a small amount of a crosslinking agent and an oxidizing radical polymerization initiator are previously mixed, the mixture is applied to a fibrous substrate and an amine or a reducing agent is added to form a redox system thereby initiating polymerization (see Japanese Patent Application No. 238421/85);

(4) A method that an aqueous solution of an acrylic acid type monomer containing a small amount of a crosslinking agent and an amine or a reducing agent are mixed, followed by application to a fibrous substrate and then addition of an oxidizing radical polymerization initiator to form a redox system thereby initiating polymerization (see Japanese Patent Application No. 238420/85); and (5) A method that an aqueous solution of an acrylic acid type monomer is previously impregnated into a fibrous substrate and then a water soluble radical polymerization initiator is added in a mist form, followed by polymerization by heating if the polymerization initiator used is not a redox type (see Japanese Patent Application No. 149609/85).

Step (C)

Crosslinking treatment

The crosslinking treatment according to the present invention comprises reacting the carboxyl groups and/or carboxylate groups, which are contained in the water absorptive polymer in the composite obtained as above, with a crosslinking agent having at least two functional groups reactive with the above groups.

As the functional groups utilized in the present invention, there may be mentioned epoxide group, aldehyde group, alcoholic hydroxyl group, primary or secondary amine, and the like.

Specific compounds containing at least two such groups thus includes polyglycidyl ethers such as ethylene glycol diglycidyl ether and polyethylene glycol diglycidyl ether; haloepoxy compounds such as epichlorohydrin; polyaldehydes such as glutaric aldehyde and glyoxal; polyols such as ethylene glycol and glycerin; and polyamines such as ethylenediamine. Among these compounds polyglycidyl ethers, especially alkylene or polyalkylene glycol diglycidyl ethers (wherein the alkylene group preferably has 2 to 4 carbon atoms and the degree of poly in the polyalkylene glycol is preferably 2 to 3), are preferred.

The crosslinking reaction may be proceeded by adding the crosslinking agent uniformly to the composite from the step (B). What should be noted first for carrying out the crosslinking is the water content of the composite. If the composite contains excessive amount of water or, adversely, it is excessively dried, crosslinking by no means proceeds efficiently whereby the effect intended by the present invention of enhancing the water absorption velocity of the composite is made very small. The water content of the composite is preferably from 1 to 1,000 % by weight, more preferably from 10 to 100% by weight, based on the weight of the polymer in the composite derived from the polymerizable monomer.

The amount to be added of the crosslinking agent is about 0.01 to 10%, preferably about 0.1 to 5% by weight, based on the weight of the polymer in the composite.

The temperature and time usable in the crosslinking reaction may vary depending upon the type of the crosslinking agent used. The temperature is generally from 50° to 200° C., preferably from 100° to 150° C., and the time is generally from a few seconds to 5 hours, preferably from a few seconds to 1 hour.

Since the amount of the crosslinking agent used is small as described above, it is preferred to add the crosslinking agent in a solution form to the composite from the step (B) by coating, spraying or impregnating in order to effect uniform addition.

For carrying out the crosslinking treatment, any method or means can be used as far as it is suited for the object. Specific methods include, for example, a batchwise heating method using a boxy reactor whose inner temperature is maintained at a predetermined level and a continuous heating method wherein the composite is continuously contacted with a roller whose surface temperature is maintained at a predetermined level using steam or the like.

Heating may be conducted under vacuum, in the presence of an inorganic gas such as nitrogen, argon, helium or the like, and preferably in air.

EXAMPLES

Example 1

In a 100 cc conical flask, 13.1 g of sodium hydroxide (purity: 95% by weight) was placed and neutralized by slowly adding 30 g of acrylic acid under ice cooling. The aqueous solution exhibited a neutralization degree of about 75% and a monomer concentration of about 45% by weight.

As a radical polymerization initiator, 0.05 g of potassium persulfate was added to and dissolved in the aqueous solution, and deaeration was conducted using $N_2$.

Separately, 0.583 g of a polyester nonwoven fabric was provided, and the above mentioned monomer solution was applied by a roll coater on the whole surface of the nonwoven fabric in such a manner as to form a pattern of stripes along the fibers. The weight of the monomer thus impregnated was 6.8 times the weight of the nonwoven fabric. The nonwoven fabric was placed in a constant temperature reaction bath which had preliminarily been deaerated with $N_2$ and heated to 90° C. Polymerization started immediately and a composite in which a highly water absorptive polymer comprising a partially neutralized self-crosslinked sodium polyacrylate was firmly held on the polyester nonwoven fabric in a pattern of stripes along the fibers was obtained.

Next, the composite was adjusted to a water content of 25% by weight (based on the weight of the highly water absorptive polymer; similarly as in the following examples) and 0.017 g of ethylene glycol diglycidyl ether in a solution form was sprayed onto the composite, and then the composite was placed in a constant temperature bath whose inner temperature was maintained at 120° C. and left there for 15 minutes to obtain a water absorptive composite material.

The properties of the water absorptive composite material is shown below (as in the following Examples).

Example 2

In a 100 cc conical flask, 13.1 g of sodium hydroxide (purity: 95% by weight) was placed and dissolved in 39.0 g of pure water under ice cooling. The aqueous solution was neutralized by slowly adding 30 g of acrylic acid under ice cooling. The aqueous solution exhibited a neutralization degree of about 75% and a monomer concentration of about 45% by weight. 0.005 g of N,N'-methylenebisacrylamide as a crosslinking agent and 0.1 g of 2,2'-azobis(2-amidinopropane) dihydrochloride as a radical polymerization initiator were dissolved in the aqueous monomer solution, and deaeration was conducted with $N_2$.

Separately, 0.655 g of a polyester nonwoven fabric was provided, and the above mentioned raw material was applied on the whole surface of the nonwoven fabric by a roll coater in such a manner as to form a pattern of stripes along the fibers. The amount of the monomer thus impregnated was 7.5 times the weight of the nonwoven fabric. The nonwoven fabric was placed in a constant temperature reaction bath which had preliminarily been deaerated with $N_2$ and heated to 90° C. Polymerization started immediately and a composite in which a highly water absorptive polymer comprising a partially neutralized sodium acrylate crosslinked with N,N'-methylenebisacrylamide was firmly held on the polyester nonwoven fabric in a pattern of stripes along the fibers was obtained.

Next, the composite was adjusted to a water content of 28% by weight and 0.025 g of ethylene glycol diglycidyl ether was added thereto, and then the composite was placed in a constant temperature bath whose inner temperature was maintained at 120° C. and left there for 15 minutes to obtain a water absorptive composite material.

Example 3

In a 100 cc conical flask, 30 g of acrylic acid was placed and 9.3 g of pure water was added to and mixed with it. The mixture was neutralized by slowly adding 20.6 g of potassium hydroxide (85% by weight) under ice cooling and maintained at a temperature of 70° C. The aqueous solution exhibited a neutralization degree of about 75% and a monomer concentration of about 74% by weight.

Separately, as a radical polymerization initiator, 0.2 g of potassium persulfate was dissolved in 3 g of water.

0.5869 g of a rayon nonwoven fabric was provided and maintained at a temperature of about 70° C. in a constant temperature bath. The aqueous radical polymerization initiator solution was mixed with the aqueous monomer solution mentioned above, and the mixture was immediately sprayed through a spraying nozzle onto the above mentioned nonwoven fabric. Polymerization started immediately and a composite in which a highly water absorptive polymer comprising a partially neutralized self-crosslinked potassium polyacrylate was firmly held on the rayon nonwoven fabric was obtained. The amount of the monomer thus coated was 12 times the weight of the nonwoven fabric, and the highly water absorptive polymer had a particle diameter in the range of 100–300 μm.

Next, the composite was adjusted to a water content of 25% by weight and 0.038 g of ethylene glycol diglycidyl ether was added thereto, and then the composite was placed in a constant temperature bath whose inner temperature was maintained at 120° C. and left there for 15 minutes to obtain a water absorptive composite material.

Example 4

In a 100 cc conical flask, 26.9 g of 25% aqueous ammonia was placed and neutralized by slowly adding 30 g of acrylic acid under ice cooling and heated to a temperature of 70° C. The aqueous solution exhibited a neutralization degree of about 95% and a monomer concentration of about 65% by weight.

Separately, 0.2 g of potassium persulfate as a radical polymerization initiator was dissolved in 3 g of water.

0.4695 g of a polyester nonwoven fabric was provided and maintained at a temperature of about 70° C. in a constant temperature bath. The aqueous radical polymerization initiator solution was mixed with the aqueous monomer solution mentioned above, and the mixture was immediately sprayed through a spraying nozzle onto the above mentioned nonwoven fabric. Polymerization started immediately and a composite in which a highly water absorptive polymer comprising a partially neutralized self-crosslinked. ammonium polyacrylate was firmly held on the rayon nonwoven fabric was obtained. The amount of the monomer thus applied was 8 times the weight of the nonwoven fabric, and the highly water absorptive polymer had a particle diameter in the range of 100–250 μm.

Next, the composite was adjusted to a water content of 15% by weight and 0.021 g of ethylene glycol diglycidyl ether was added thereto, and then the composite was placed in a constant temperature bath whose inner temperature was maintained at 120° C. and left there for 15 minutes to obtain a water absorptive composite material.

Example 5

In a 100 cc conical flask, 30 g of acrylic acid was placed and 16.9 g of pure water was added to and mixed with it. The mixture was neutralized by slowly adding 0.6 g of potassium hydroxide (85% by weight) under ice cooling. The aqueous solution exhibited a neutralization degree of about 75% and a monomer concentration of about 65% by weight.

0.1 g of N,N'-methylenebisacrylamide as a crosslinking agent was added to and dissolved in the above mentioned monomer solution, and the mixture was heated to 40° C. 0.4 g of 31% aqueous hydrogen peroxide as a radical polymerization initiator was dissolved in the mixture.

0.6521 g of a polyester nonwoven fabric was provided, and the whole surface of the nonwoven fabric was coated and impregnated with the aforementioned raw material using a roll coater, and the nonwoven fabric thus treated was maintained at a temperature of 40° C. in a constant temperature bath. The amount of the monomer thus impregnated was 6 9 times the weight of the nonwoven fabric.

Next, an aqueous solution of 5% L-ascorbic acid was sprayed through a spraying nozzle onto the whole surface of the above mentioned nonwoven fabric. Polymerization started immediately and a composite in which a highly water absorptive polymer comprising a partially neutralized potassium polyacrylate crosslinked with N,N'-methylenebisacrylamide was firmly held on the polyester nonwoven fabric was obtained.

Next, the composite was adjusted to a water content of about 30% by weight and 0.023 g of ethylene glycol diglycidyl ether was added thereto, and then the composite was treated for 15 minutes in a constant temperature bath whose inner temperature was maintained at 120° C. to obtain a water absorptive composite material.

Example 6

In a 100 cc conical flask, 30 g of acrylic acid was placed and 16.9 g of pure water was added to and mixed with it. The mixture was neutralized by slowly adding 20.6 g of potassium hydroxide (85% by weight) under ice cooling. The aqueous solution exhibited a neutralization degree of about 75% and a monomer concentration of about 65% by weight.

0.6925 g of a polyester nonwoven fabric was provided, and the whole surface of the nonwoven fabric was coated and impregnated with the above mentioned raw material using a roll coater. The amount of the monomer impregnated was 7.5 times the weight of the nonwoven fabric.

Next, the nonwoven fabric having been impregnated with the aqueous solution of the partially neutralized potassium acrylate monomer was irradiated with electron beam at a dose of 20 Mrad by means of an electron beam generating apparatus equipped with an accelerator (DYNAMITRON). Polymerization started immediately and a composite in which a highly water absorptive polymer comprising a partially neutralized self crosslinked potassium polyacrylate was firmly held on the polyester nonwoven fabric in a pattern of stripes along the fibers was obtained.

Next, the composite was adjusted to a water content of 25% by weight and 0.029 g of ethylene glycol diglycidyl ether was added thereto, and then he composite was treated for 15 minutes in a constant temperature bath whose inner temperature was maintained at 120° C. to obtain a water absorptive composite material.

Example 7

A water absorptive composite material was obtained in the same manner as in Example 1 except that 0.025 g of propylene glycol diglycidyl ether was used in place of ethylene glycol diglycidyl ether in Example 1.

Example 8

A water absorptive composite material was obtained in the same manner as in Example 3 except that 0.045 g of neopentyl gycol diglycidyl ether was used in place of ethylene glycol diglycidyl ether in Example 3.

Example 9

A water absorptive composite material was obtained in the same manner as in Example 5 except that 0.040 g of glycerol polyglycidyl ether was used in place of ethylene glycol diglycidyl ether in Example 5.

Comparative Examples 1–6

The precursor composites obtained in Examples 1–6, that is the composites before the addition of ethylene glycol diglycidyl ether are herein regarded as the composites in Comparative Examples 1–6, respectively.

For the water absorptive composite materials obtained in Examples and the composites obtained in Comparative Examples, the following tests were carried out to evaluate physiological saline absorption capacity and water absorption velocity. The results are shown in Table 1.

A. Physiological saline absorption capacity

About 0.5 g of the composite or water absorptive composite material and about 200 g of a saline solution having a concentration of 0.9% by weight were precisely weighed, respectively and charged in a 300 ml beaker. The beaker was left standing for about 4 hours to swell the polymer satisfactorily with the solution. The beaker content was filtered through a 100-mesh sieve, and the amount of the filtrate is weighed and the physiological saline absorption capacity is calculated according to the following equation:

$$\text{Physiological saline absorption capacity} = \frac{\text{Charged amount of physiological saline (g)} - \text{Amount of filtrate (g)}}{\text{Charged amount of the composite or water absorptive composite material (g)}}$$

B. Water absorption velocity

About 200 g of a saline solution having a concentration of 0.9% by weight was weighed and charged in a 300 ml beaker. Subsequently, about 0.5 g of the composite or water absorptive composite material was weighed and added to the above mentioned solution. After 5 minutes, the beaker content was filtered through a 100 mesh sieve. The amount of the filtrate was weighed and the physiological saline absorption capacity was calculated according to the equation described in A, which was regarded as water absorption velocity.

TABLE 1

| Example No. | Physiological saline absorption capacity (g/g) | Water absorption velocity (g/g) |
|---|---|---|
| Example | | |
| 1 | 37.3 | 31.5 |
| 2 | 40.5 | 32.8 |
| 3 | 60.2 | 49.3 |
| 4 | 61.3 | 53.8 |
| 5 | 51.5 | 40.3 |
| 6 | 15.5 | 14.5 |
| 7 | 38.3 | 27.6 |
| 8 | 58.3 | 45.5 |
| 9 | 49.8 | 41.2 |
| Comp. Example | | |
| 1 | 38.8 | 11.5 |
| 2 | 42.1 | 10.1 |
| 3 | 65.8 | 29.5 |
| 4 | 65.6 | 23.8 |
| 5 | 52.3 | 10.5 |
| 6 | 15.2 | 9.5 |

The water absorptive composite material obtained by the process of this invention, as apparent from the results shown in Table 1, has remarkably high water absorption velocity as compared with those in prior art. Further, the composite material handles easily because of its sheet form as compared with conventional powdery water absorptive resins, so that they can be used advantageously for the production of a variety of sanitary goods such as a sanitary napkin, paper diaper and the like.

The water absorptive composite material according to this invention, taking advantage of its excellent water absorption capacity and easy handling, can be also used for the production of a variety of materials for gardening and agriculture such as a soil conditioner and a water retaining agent which have recently attracted public attention.

What is claimed is:

1. A process for preparing a water absorptive composite material, which comprises the combination of the following steps of:

(A) applying an aqueous solution of a polymerizable monomer comprising as a main component acrylic acid, of which 20% or more of the carboxyl groups have been neutralized to its alkali metal salt or ammonium salt, to a prefabricated fibrous substrate;

(B) polymerizing the polymerizable monomers applied to said fibrous substrate to form a composite of a polymer derived from said polymerizable monomer and said fibrous substrate; and (C) adding to said composite a crosslinking agent having two or more functional groups reactive with the carboxyl group and/or carboxylate group contained in the polymer to react therewith.

2. A process according to claim 1, wherein the polymerizable monomer comprises acrylic acid of which 50% or more of the carboxyl groups have been neutralized to its alkali metal salt or ammonium salt.

3. A process according to claim 1, wherein the polymerizable monomer contains up to 20 mol % of at least one of the monomers selected from the group consisting of 2-acrylamide-2-methylpropanesulfonic acid, 2acryloylethanesulfonic acid, 2-acryloylpropanesulfonic acid, methacrylic acid and alkali metal salts or ammonium salts thereof, acrylamide, methacrylamide, N,N-dimethylacrylamide, N,N-dimethylmethacrylamide, 2-hydroxyethyl acrylamide, 2-hydroxyethyl methacrylamide, 2-vinylpyridine, 2-hydroxyethyl acrylate, 2-hydroxyethyl methacrylate, 2-hydroxypropyl acrylate, 2-hydroxypropyl methacrylate, polyethylene glycol monoacrylate, polyethylene glycol monomethacrylate, N,N'-methylenebisacrylamide, N,N'-methylenebismethacrylamide, polyethylene glycol diacrylate and polyethylene glycol dimethacrylate.

4. A process according to claim 1, wherein the fibrous substrate formed in step (A) comprises as a main component a fiber selected from the group consisting of a cellulose fiber, a polyester fiber and a mixture thereof.

5. A process according to claim 1, wherein the fibrous substrate is a pad of loose fabric, a carded web, an air-laid web, a paper, a nonwoven fabric, a woven fabric or a knitted fabric.

6. A process according to claim 1, wherein the stage of applying the aqueous solution of the polymerizable monomer in the step (A) to the prefabricated fibrous substrate comprises spraying of said aqueous solution to said fibrous substrate or impregnation of said fibrous substrate with said aqueous solution.

7. A process according to claim 1, wherein the amount of the polymerizable monomer applied to the fibrous substrate in the step (A) is in a proportion of 1–10,000 parts by weight per 100 parts by weight of the fibrous substrate.

8. A process according to claim 1, wherein the polymerization in the steps (B) is conducted by the action of a water soluble radical polymerization initiator.

9. A process according to claim 8, wherein the stage of polymerizing the polymerizable monomer in the step (B) by means of the water soluble radical polymerization initiator involves the decomposition of said polymerization initiator while it is previously dissolved in the aqueous solution of the monomer for polymerization, or the spraying of said polymerization initiator in a solution form to the fibrous substrate before decomposition thereof.

10. A process according to claim 1, wherein the composite to be treated in the step (C) contains water in a proportion of 0.01 to 10 parts by weight per part by weight of the polymer derived from the polymerizable monomer.

11. A process according to claim 1, wherein the crosslinking agent added in the step (C) has glycidyl groups as the functional groups reactive with the carboxyl group and/or carboxylate group.

12. A process according to claim 11, wherein the crosslinking agent having glycidyl groups is a polyglycidyl ether.

13. A process according to claim 12, wherein the polyglycidyl ether is an alkylene or polyalkylene glycol diglycidyl ether wherein the alkylene group has 2 to 4 carbon atoms and the degree of poly in the polyalkylene glycol is 2 to 3.

* * * * *